US006488727B2

(12) United States Patent
Naegeli et al.

(10) Patent No.: US 6,488,727 B2
(45) Date of Patent: Dec. 3, 2002

(54) METHOD FOR PRODUCING OXYGENATED FUELS

(75) Inventors: David W. Naegeli, San Antonio, TX (US); Kenneth H. Childress, San Antonio, TX (US); David S. Moulton, Hondo, TX (US); Paul I. Lacey, The Woodlands, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 09/797,477

(22) Filed: Feb. 28, 2001

(65) Prior Publication Data

US 2001/0045054 A1 Nov. 29, 2001

Related U.S. Application Data

(60) Provisional application No. 60/185,242, filed on Feb. 28, 2000.

(51) Int. Cl.[7] ..... C10L 1/12
(52) U.S. Cl. ..... 44/457
(58) Field of Search ..... 44/300, 457

(56) References Cited

U.S. PATENT DOCUMENTS 2,077,406 A * 4/1937 Gaertner
2,194,887 A * 3/1940 Lamprecht
4,334,889 A * 6/1982 Takabayashi
5,308,365 A 5/1994 Kesling, Jr. et al. ..... 44/447
5,645,613 A 7/1997 Benham et al. ..... 44/452
5,746,785 A * 5/1998 Moulton et al. ..... 44/443
5,763,716 A 6/1998 Benham et al. ..... 585/315
5,906,664 A 5/1999 Basu et al. ..... 44/446
5,942,203 A 8/1999 Van Dijk et al. ..... 423/359

FOREIGN PATENT DOCUMENTS

EP 0 252 606 A2 1/1988 ..... C10G/27/04

OTHER PUBLICATIONS

Naegeli, D.W., et al.; "Kinetics of Deposit Precursors in Jet Fuels"; Symposium on Structure of Jet Fuels V Presented Before the Division of Petroleum Chemistry, Inc. 216th National Meeting, American Chemical Society, Boston, MA, Aug. 23–27, 1998.

Naegeli, David W.; "The Role of Sulfur in the Thermal Stability of Jet Fuel"; Presented at the International Gas Turbine & Aeroengine Congress & Exhibition, Indianapolis, IN; Jun. 7–10, 1999.

PCT/US01/06662 Search Report, Sep. 28, 2001.

* cited by examiner

*Primary Examiner*—Margaret Medley
(74) *Attorney, Agent, or Firm*—Baker Botts, L.L.P.

(57) ABSTRACT

A method of producing oxygenated fuel. The method operates on a sulfur-free base fuel. Oxygen gas is introduced into the base fuel, which is heated, using a sparging process. Water is then removed from the resulting oxygenated fuel.

15 Claims, 1 Drawing Sheet

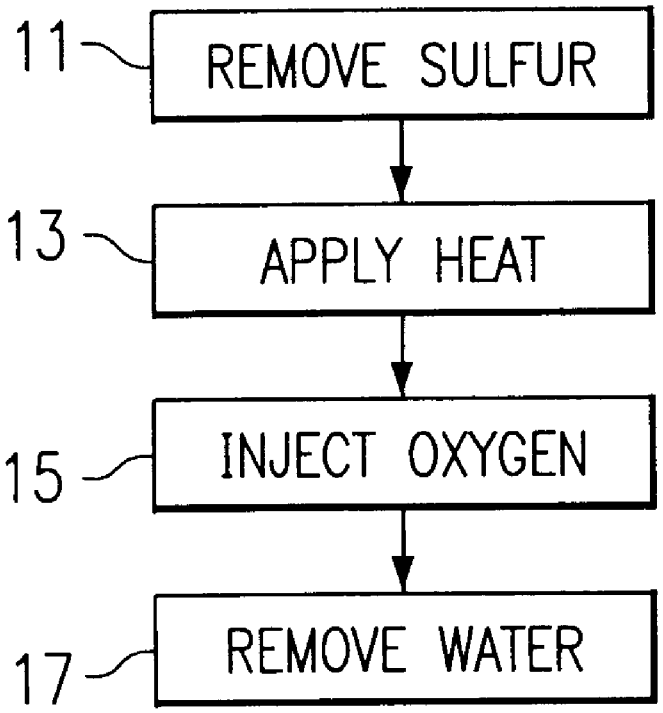
11
REMOVE SULFUR
13
APPLY HEAT
15
INJECT OXYGEN
17
REMOVE WATER

METHOD FOR PRODUCING OXYGENATED FUELS

RELATED PATENT APPLICATION

This application claims the benefit of U.S. Provisional Application No. 60/185,242, filed Feb. 28, 2000 and entitled "Method for Producing Oxygenated Diesel Fuel of Superior Quality".

TECHNICAL FIELD OF THE INVENTION

This invention relates to methods of producing liquid fuels used for transportation engines, and more particularly to a method for producing oxygenated gasoline and diesel fuels.

BACKGROUND OF THE INVENTION

Recent studies have shown that adding oxygenates to conventional diesel fuel results in substantial reduction of particulate emissions. The extent of reduction correlates with the oxygen content of the fuel.

The conventional method of making oxygenated fuel involves adding a compound, or a mixture of compounds, that contains oxygen in its molecular structure. The fuel manufacturer purchases the oxygen-containing compound or mixture and blends it with diesel fuel.

The conventional method of producing oxygenated diesel fuel significantly increases fuel manufacturing costs. The oxygenated materials to be added are generally made from materials that would otherwise be used as fuels. Thus, adding the oxygenates to the fuel also adds the costs of separating their feed stocks from the fuel, manufacturing the oxygenates, and distributing the oxygenates to the costs of diesel fuel production. There are other disadvantages with conventional oxygenated fuels, such as lower volumetric heating value as compared to non oxygenated fuel.

SUMMARY OF THE INVENTION

One aspect of the invention is an autoxidation method of producing oxygenated fuel. First, the sulfur is removed from a base fuel. The sulfur-free base fuel is then heated to a temperature in the range of 150–200 degrees centigrade. Oxygen gas is added, using a sparging procedure. Finally, impurities resulting from the above steps are separated from the oxygenated fuel.

An advantage of the invention is that it provides oxygenated diesel fuel from a sulfur-free base diesel fuel. The oxygenated fuel produces lower particulate emissions from diesel engines than non-oxygenated, sulfur-free diesel fuel. It can be used in engines designed to operate on hydrocarbon fuels, without requiring engine modification or adjustment.

As compared to conventional methods of making oxygenated fuels, an advantage of the invention is that the method is less expensive. It does not require the purchase of an oxygenated compound or mixture. It can be implemented with equipment commonly used in the fuel manufacturing industry. It can be made in large quantities at a reasonable cost and in an energy efficient manner. The process may be added to existing refinery processes.

Manufacturing yields are high. The yield of oxygenated diesel fuel from a base fuel is expected to be at least 95% of the original volume of base fuel.

The method produces oxygenated diesel fuel having properties superior to oxygenated fuels made by conventional methods. In particular, it produces fuel with higher volumetric heating value and generally a higher flash point than oxygenated diesel fuels made by conventional methods.

BRIEF DESCRIPTION OF THE DRAWINGS

FIG. 1 illustrates the autoxidation process in accordance with the invention.

DETAILED DESCRIPTION OF THE INVENTION

The following description is directed to a method of producing oxygenated diesel fuel by incorporating oxygen in the fuel through a process of autoxidation. It has been experimentally determined that as much as 9 weight percent oxygen can be incorporated in sulfur-free diesel fuels.

FIG. 1 illustrates the basic steps of the method. It is assumed that a volume of diesel fuel is contained in a suitable container, which may be associated with conventional reactor equipment. For reasons discussed below, the container may be relatively tall and narrow, which increases the residence time of injected oxygen.

As indicated in Step 11, the process operates on a sulfur-free diesel fuel. This is important because an acid is formed when sulfur oxidizes, and this catalyzes the decomposition of benzylic hydroperoxides to phenols. Phenols are antioxidants that inhibit the autoxidation of diesel fuel. Higher temperatures are required to autoxidize the fuel when inhibitors are present. But the use of higher temperatures causes both low yield and poor quality fuel.

Sulfur may be removed by known processes, such as by adding hydrogen to the fuel at high temperature and pressure. This process is known as hydrotreating the fuel, a process that converts the sulfur to hydrogen sulfide, which is subsequently taken out of the fuel by a stripping operation.

In Step 13, the sulfur-free base diesel fuel is heated. A typical range of temperatures for the autoxidation is from 160 to 200 degrees centigrade. Step 13 and the subsequent steps may occur at atmospheric pressure.

In Step 15, oxygen is introduced into the base fuel. This may be accomplished by a sparging process, which involves the injection of oxygen, under pressure, into the fuel at or near the bottom of the container. The sparging creates subsurface bubbles or gas pathways horizontally and vertically from the injection point, and causes contacting and mixing between the injected oxygen and the fuel.

The heat and pressure cause the oxygen to dissolve in the fuel. The fuel reacts with the dissolved oxygen, producing oxygenated diesel fuel and water. The height of the container and the temperature of the fuel are factors that may be used to maximize the residence time of the oxygen during the sparging procedure, and therefore maximize utilization of the oxygen.

Step 17 is removing the water and gases that are not consumed during the sparging step. This may be accomplished by means well known in the fuels manufacturing industry, such as by inert gas stripping. A condenser may be placed at the top of the fuel container for this purpose, and used with an oil-water separator. In the separator, condensed liquids from the condenser are separated into a fuel phase and an aqueous phase. The fuel phase is added back to the oxygenated diesel fuel and the aqueous phase is removed.

Although not illustrated in FIG. 1, an additional step of the method could be to add a "promoter" to increase the rate of oxidation. An example of such a promotor is ozone in the oxygen added to the base diesel fuel.

Experimentation has been performed on two diesel fuels, a Fisher Tropsch diesel (FTD) and a hydrotreated diesel (HTD), which were oxidized at 160 degrees centigrade in accordance with the invention. Both test fuels were free of sulfur.

TABLE 1 illustrates the results of experimentation with FTD and HTD fuels. In these experiments, oxygenated diesel fuels were prepared in a 125 milliliter bottle that contained 10 grams of fuel and pure oxygen in the vapor space. The oxygen was consumed in about 90 minutes at 160 degrees centigrade. The autoxidation was repeated so as to result in an oxygen content of about 6% in the fuel. The physiochemical properties of the base FTD and HTD fuels as well as their respective products, OFTD and OHTD, are illustrated. The experimental results result in yields in the range of 90 to 95 percent by volume of the base fuel. It is expected that higher yields can be accomplished in commercial practice.

While the base diesel fuel oxidizes, its density increases and its net heat of combustion per unit mass decreases. This is to be expected when oxygen is incorporated into a fuel. However, with the method of the invention, there is only a slight decrease in the net heat of combustion per unit volume. Specifically, the net heats of combustion per unit volume decreases relative to the base fuel by only 1.2 and 1.6 percent for OFTD and OHTD, respectively. In other words, diesel fuel that is oxygenated in accordance with the invention has a high volumetric energy density, which can be within 1.6 percent of the energy density of the sulfur-free fuel before oxygenation. In comparison, when pure oxygenates, such as methanol, are added to diesel fuel in amounts that achieve comparable oxygen concentrations, the net heat of combustion per unit volume of the oxygenated fuel can be as much as 10 percent lower than that of the base fuel.

The boiling point distributions of OFTD and OHTD are only slightly broadened over that of their base fuels. This indicates that the flash points, freeze points, and viscosity are not significantly changed by the autoxidation process.

Lubricity is improved substantially by the autoxidation process. Wear scars for sulfur-free non oxygenated fuels are outside an acceptable range. Typically, sulfur-free fuels have poor lubricity because polar compounds containing oxygen, sulfur, and nitrogen have been removed. However, for fuels oxygenated in accordance with the invention, the wear scars are acceptable. The autoxidation replaces these compounds with polar oxygenates and thereby improves lubricity.

Although the above description is in terms of diesel fuel, the same concepts could be applied to other liquid transportation fuels. For example, gasoline or jet fuel could be oxygenated in the manner described above.

| Physicochemical Property | FTDF | OFTDF | HTD | OHTD |
|---|---|---|---|---|
| Yield, % of Initial Weight | ***** | 95 | ***** | 90 |
| Density, g/cm$^3$ | 0.7732 | 0.8115 | 0.8122 | 0.8651 |
| Carbon Content, wt. % | 84.76 | 80.61 | 85.43 | 80.69 |
| Hydrogen Content, wt. % | 15.03 | 13.98 | 14.43 | 13.09 |
| *Oxygen Content, wt. % | 0.21 | 5.41 | 0.14 | 6.22 |
| Water Content, ppm | 150 | 512 | 261 | 1070 |
| Gross Heat of Comb. Btu/lb | 19,606 | 18,449 | 19,713 | 18,191 |
| Net Heat of Comb., Bru/lb | 18,235 | 17,174 | 18,397 | 16.997 |
| Net Heat of Comb. Btu/Gal | 117,546 | 116,190 | 124,588 | 122,588 |
| Lubricity, microns | 570 | 365 | 550 | 370 |
| Initial Boiling Point, ° C. | 151.1 | 146.9 | 109.4 | 151.0 |
| 10% Off. ° C. | 237.6 | 236.7 | 211.0 | 228.0 |
| 20% Off. ° C. | 257.4 | 256.0 | 235.0 | 250.7 |

-continued

| Physicochemical Property | FTDF | OFTDF | HTD | OHTD |
|---|---|---|---|---|
| 30% Off. ° C. | 274.7 | 273.8 | 253.3 | 267.8 |
| 40% Off. ° C. | 290.3 | 289.7 | 271.1 | 282.9 |
| 50% Off. ° C. | 304.1 | 304.3 | 286.2 | 297.2 |
| 60% Off. ° C. | 312.4 | 317.6 | 300.5 | 311.6 |
| 70% Off. ° C. | 324.5 | 331.3 | 315.4 | 328.3 |
| 80% Off. ° C. | 337.4 | 345.7 | 331.1 | 347.3 |
| 90% Off. ° C. | 352.4 | 364.0 | 356.3 | 374.9 |
| Final Boiling Point, "C" | 377.7 | 437.4 | 417.9 | 439.4 |

Other Embodiments

Although the present invention has been described in detail, it should be understood that various changes, substitutions, and alterations can be made hereto without departing from the spirit and scope of the invention as defined by the appended claims.

What is claimed is:

1. A method of producing oxygenated fuel, comprising the steps of:

removing the sulfur from a base fuel;

heating the sulfur-free base fuel to a temperature in the range of 150–200 degrees centigrade;

sparging the heated fuel with oxygen gas;

condensing impurities resulting from the above steps; and separating the impurities from the oxygenated fuel.

2. The method of claim 1, wherein the fuel is diesel fuel.

3. The method of claim 1, further comprising the step of adding ozone to the base fuel.

4. The method of claim 1, wherein the heating, adding, and removing steps are performed at atmospheric pressure.

5. The method of claim 1, wherein the adding step is performed by a sparging process.

6. The method of claim 1, wherein the removing step is performed with a hydrotreating process.

7. The method of claim 1, further comprising the step of adjusting the residence time of the oxygen during the adding step.

8. A method of producing oxygenated fuel from a sulfur-free base fuel, comprising the steps of:

heating the sulfur-free base fuel to a temperature in the range of 150–200 degrees centigrade;

sparging the heated fuel with oxygen gas; and condensing impurities resulting from the above steps; and separating the impurities from the oxygenated fuel.

9. The method of claim 8, wherein the fuel is diesel fuel.

10. The method of claim 8, further comprising the step of adding ozone to the base fuel.

11. The method of claim 8, wherein the heating, adding, and removing steps are performed at atmospheric pressure.

12. A method of producing oxygenated fuel from a sulfur-free base fuel, comprising the steps of:

heating the sulfur-free base fuel to a temperature in the range of 150–200 degrees centigrade;

adding ozone-enhanced oxygen gas to the heated fuel; and condensing impurities resulting from the above steps; and separating the impurities from the oxygenated fuel.

13. The method of claim 8, further comprising the step of adjusting the residence time of the oxygen during the adding step.

14. The method of claim 10, further comprising the step of generating ozone in a manner to co-produce singlet oxygen so that the oxygen carries both ozone and singlet oxygen into the fuel.

15. A method of producing oxygenated fuel, comprising the steps of:

removing the sulfur from a base fuel;

heating the sulfur-free base fuel to a temperature in the range of 150–200 degrees centigrade;

adding ozone-enhanced oxygen gas to the heated fuel;

condensing impurities resulting from the above steps; and separating the impurities from the oxygenated fuel.

* * * * *